US007984745B2

(12) United States Patent
Wen et al.

(10) Patent No.: US 7,984,745 B2
(45) Date of Patent: Jul. 26, 2011

(54) CORDLESS WINDOW BLIND STRUCTURE

(75) Inventors: Yu-Che Wen, Gueishan Township, Taoyuan County (TW); Chih-Yao Chang, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 831 days.

(21) Appl. No.: 12/003,183

(22) Filed: Dec. 20, 2007

(65) Prior Publication Data

US 2009/0159219 A1 Jun. 25, 2009

(51) Int. Cl.
*E06B 9/322* (2006.01)

(52) U.S. Cl. ..... 160/170; 160/178.1 R; 160/84.04

(58) Field of Classification Search ..... 160/170, 160/84.04, 84.05, 178.1 R; 16/197, 198
See application file for complete search history.

(56) References Cited

U.S. PATENT DOCUMENTS 4,760,622 A 8/1988 Rohrman
5,477,904 A 12/1995 Yang
7,398,815 B2 * 7/2008 Liang ..... 160/170
7,487,817 B2 * 2/2009 Liang ..... 160/170
2006/0137830 A1 * 6/2006 Lin ..... 160/84.04
2006/0137831 A1 * 6/2006 Lin ..... 160/84.04
2007/0119547 A1 * 5/2007 Liang ..... 160/170
2007/0125505 A1 * 6/2007 Liang ..... 160/170
2007/0272364 A1 * 11/2007 Liang ..... 160/84.05
2007/0284060 A1 * 12/2007 Liang ..... 160/170
2008/0289774 A1 * 11/2008 Ying ..... 160/178.1 R
2009/0159219 A1 * 6/2009 Wen et al. ..... 160/170

* cited by examiner

*Primary Examiner* — Blair M. Johnson
(74) *Attorney, Agent, or Firm* — Birch, Stewart, Kolasch & Birch, LLP

(57) ABSTRACT

A cordless window blind structure is provided. A movable seat having a pulley block and a cord-winding assembly is disposed within a head rail of the cordless blind. The pulley block is connected to a lift cord wound through a first positioning element, so as to control the opening and closing of a blind body. And the cord-winding assembly has a cord winder attached to one end of a retrieving cord and a torsion spring. The other end of the retrieving cord is fastened either on the head rail, the movable seat, a second positioning element, or an end cap. The structure of the second positioning element is resembled to the first positioning element. By taking one end of the retrieving cord as a pivot, the movable seat moves laterally therealong the head rail by a restoring force generated through the torsion spring.

17 Claims, 7 Drawing Sheets

CORDLESS WINDOW BLIND STRUCTURE

BACKGROUND OF THE INVENTION

1. Field of the Invention

The present invention relates to a cordless window blind structure, and more particularly to a structure which allows greater extent of head rail cut-down on both distant ends and meanwhile increases the drop length of the window blind.

2. Description of Related Art

A conventional window blind structure is usually formed by a blind body, a driving assembly, and a pull cord. In operation, a user must draw the pull cord as a means to open or close the window blind to a desirable position. However, the small frictional surface of the pull cord tends to rub against the hands exerting force thereon, and thus hurting the area of hands contacting with it. Besides, in case of an excessive down-pulling force exerted onto the pull cord or a sudden release at a great speed, the blind body cannot be accurately positioned in a desirable position and the adjustment process must be repeated over again, which is quite inconvenient in operation and may hurt the user's hand.

In order to solve the problems of the conventional window blind operated by the pull cord, several techniques have already been disclosed in the prior art, for example, U.S. Pat. No. 4,760,622 and U.S. Pat. No. 5,477,904.

With reference to U.S. Pat. No. 4,760,622, the dual combination of the winding apparatus and counterbalance system function to save amount of force exerted by the user and meanwhile enabling the heavier windows to be raised in a counterbalanced way. The window has front and back panels installed at different rails, so that both the winding apparatus and counterbalance system must be installed in respective track, which complicates the whole structure and occupies quite a large space.

With reference to U.S. Pat. No. 5,477,904, it discloses a window curtain assembly having a spring tension mechanism. The extend-retract position of the window blind is operatively controlled by a handle without an exposed cord, so it is quite convenient for the user. However, as the interengagement of the spring tension mechanism and the whole window curtain assembly does not generate a friction force during practical operation thereby, the whole curtain body must be completely drawn out and then fastened to a buckle through a handle means. That is, the window blind is not capable of achieving a counterbalanced state at any particular position. Also, the spring tension mechanism must be correspondingly fixed to two utmost ends of a tubular frame (the head rail), so the structure of such window curtain assembly is not capable for a stock size window blind which may require cut-down at both distant ends in accordance with the customers' needs.

As an extendable-retractable spring is installed within the blind assembly as disclosed from above prior art, the associated components of the head rail cannot be disposed at the center portions of the head rail, and the relevant moving stroke of the components therealong the head rail can not be further reduced. However, this apparently is not a problem with the construction shown in U.S. Publication Patent No. 20070119547 due to the extension spring is replaced with a torsion spring.

The U.S. Publication Patent No. 20070119547 discloses a cordless window blind structure of which the user is not only allowed to operate the window blind in a counterbalanced way, but also the overall blind structure is further simplified. However, the associated head rail components (for example, a fixing base and a cord-winding control unit) must be respectively fixed on both utmost ends of the head rail, limiting the possibility for head rail cut-down at both distant ends.

In addition, when the movable seat is activated by a retrieving cord, this in turn will simultaneously generate a torque force causing the movable seat to decline or move sideway therealong the head rail, therefore, the movable seat must be made with a longer length to stay clear from this circumstance. However, once the movable seat is lengthened, this in turn will substantially shorten the distance between the movable seat and the cord-winding control unit, and further minify the spare space available within the head rail, therefore, the blind may not be suitable for cut-down needs. Accordingly, the extent of expansion of the blind body is corresponding to the lateral movement of the movable seat therealong the head rail. As described above, once the distance between the movable seat and the cord-winding control unit is shortened, this in turn may place limitations on the maximum stretch characteristics that the window blind can perform, in other words, the full length of the blind is restrained.

And the pulley block of the fixing base and the torsion spring assembly of the cord-winding control unit are respectively fixed at two utmost ends of the head rail thereby, the window blind is not suitable for cut-down performance.

SUMMARY OF THE INVENTION

In accordance with the teachings of the present invention, applicants have developed a cordless window blind structure, which may achieve greater extent of cut-down requirement at both distant ends of the window blind.

The present invention is further direct to a cordless window blind structure, capable of increasing a full length for the window blind.

In order to achieve the above objectives, the present invention provides a cordless window blind structure, which includes: a head rail, having an opening hollow structure and having a predetermined length; a first positioning element, fixed within the head rail at one side corresponding to an orientation of the longitudinal axis thereof and spaced apart by a certain distance from a corresponding first end of the head rail; a movable seat, movably disposed within the head rail, and having a pulley block disposed on one side thereof adjacent to the first positioning element and having a cord-winding assembly disposed on the other side thereof; a blind body, disposed beneath the head rail; at least one lift cord, having one end wound onto the movable seat and the first positioning element, and having the other end extending throughout the head rail and a lower end of the blind body; and a retrieving cord, in which one end is connected to the cord-winding assembly, and the other end of the retrieving cord is either fixed at a predetermined position on the other side of the head rail and spaced apart by a certain distance from a corresponding second end of the head rail, or is fastened onto the movable seat after routing through the predetermined position, wherein, a predetermined distance is formed therebetween the second end of the head rail and the predetermined position.

Accordingly, the present invention further provides a second positioning element mounted within the head rail and spaced apart by a certain distance from the second end of the head rail.

A distance formed therebetween the first positioning element and the second positioning element is much smaller than the head rail length, so as to provide the spare space available for the head rail cut-down at both distant ends. Therefore, the blind manufactures only need to produce the stock size blinds of which are capable to be cut-down and made into a custom-size blind in accordance to the user's needs.

Furthermore, the moving stroke of the blind body of the present invention is determined according to the lateral movement of the movable seat therealong the head rail, and the pulley block and the cord-winding assembly are both constructed and arranged within the movable seat thereby, lateral moving space of the movable seat therealong the head rail is further increased, providing available spare space at both distant ends of the head rail for cut-down requirement, this may in turn increase the extent of maximum expansion characteristics on the blind body, which is equivalent to the full length of the window blind.

Furthermore, if both the head rail length and the blind body full length of the window blind of the present invention are the same as that of the prior art, by increasing the available space where the movable seat is moved within the head rail, both the distance between the first end of the head rail and the first positioning element and the distance between the second end of the head rail and the predetermined position (or the second positioning element) can substantially be increased as well, allowing the blind to have greater extent of cut-down portion on both distant ends of the head rail.

With the present invention, the blind assembly can not only provide greater extent of head rail cut-down needs but also lengthen the maximum expansion characteristics on the blind body, in other words, to increase the drop length of the window blind.

In order to make the aforementioned and other objectives, features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, served to explain the principles of the invention.

DESCRIPTION OF EMBODIMENTS

Preferred embodiments of the present invention are described in detail below with reference to the accompanying drawings.

Figure 1:
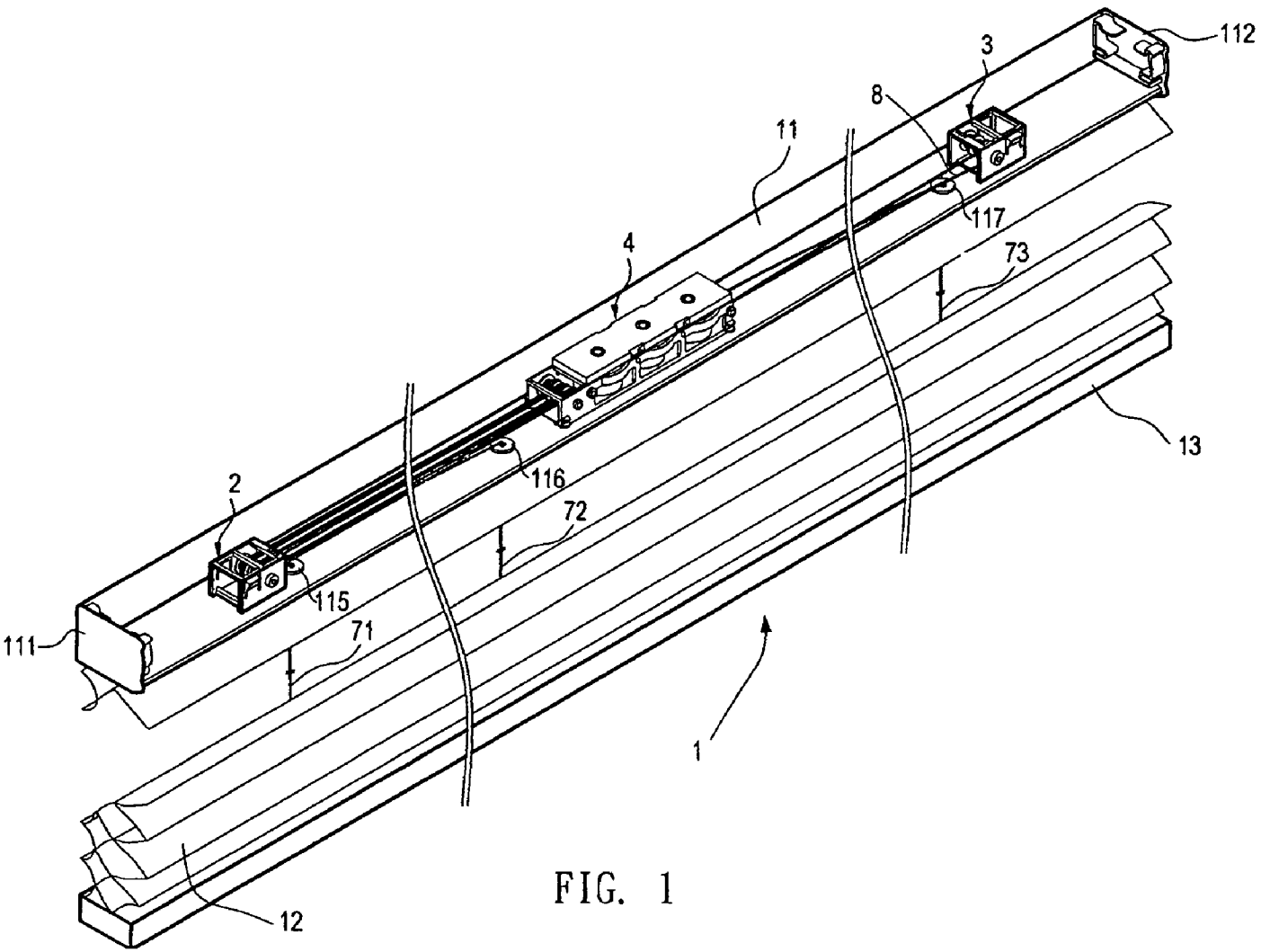
FIG. 1 is a perspective view of a preferred embodiment of the present invention.
Figure 2:
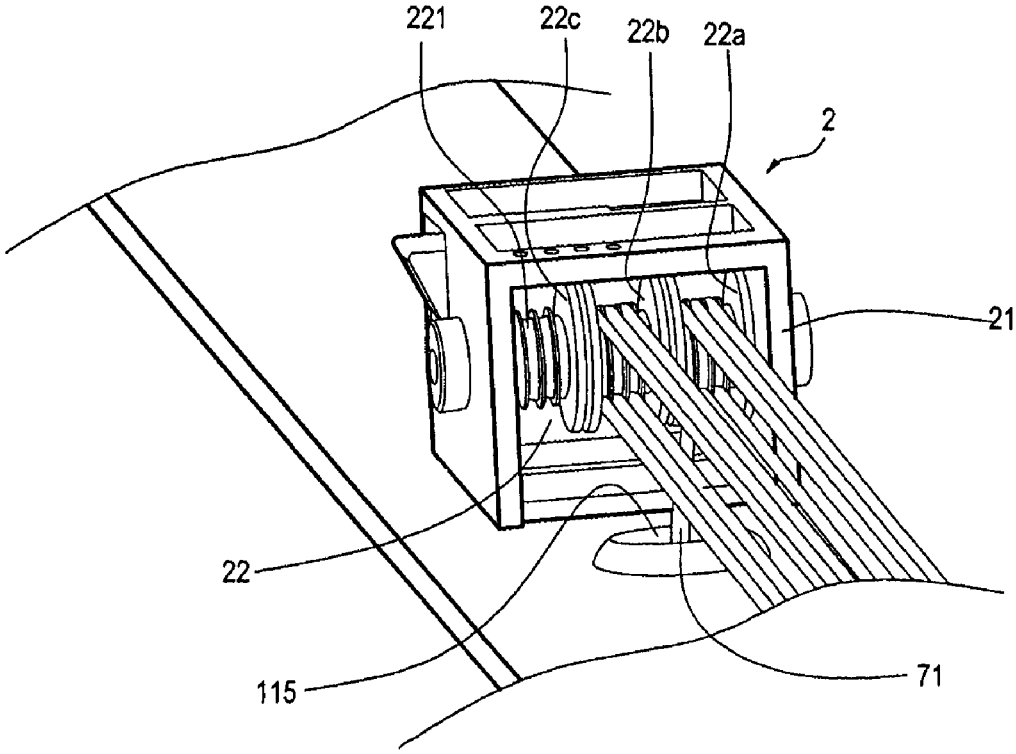
FIG. 2 is a perspective view of a first positioning element according to the present invention.

Referring to FIGS. 1 and 2, they are perspective views of a preferred embodiment of the present invention. A cordless window blind structure 1 includes a head rail 11, a first positioning element 2, a second positioning element 3, a movable seat 4, a blind body 12, a bottom rail 13, three lift cords 71, 72, and 73, and a retrieving cord 8.

The top end of the head rail 11 has an opening structure and has a predetermined length. The left and right ends of the head rail are respectively formed into a first end and a second end, and end caps 111 and 112 may be respectively disposed on the first and second ends of the head rail 11. The head rail 11 has three through holes 115, 116, and 117 disposed at a bottom portion thereof and they are correspondingly provided for the lift cords 71, 72, and 73 to pass through. The first positioning element 2 is fixed within the head rail 11 in proximity to the first end.

The first positioning element 2 has a base body 21 and a pulley block 22. The pulley block 22 of the first positioning element 2 is pivoted at the base body 21 in such a manner that the axis of the pulley block 22 is axially vertical to a longitudinal axis of the head rail 11. The pulley block 22 is formed by three pulleys 22*a*, 22*b*, and 22*c*. Each pulley has a cord groove 221 (taking the first positioning element 2 as an example), such that each lift cord 71, 72, and 73 is capable of being wound up thereon, so as to eliminate the problem on cords tangling during the winding process.

The head rail 11 has a fixing hole 113 disposed on the bottom thereof, and the base body 21 of the first positioning element 2 extends downwardly to form a snapping block 23 (shown in FIG. 4), so the base body 21 may be fixed on the head rail 11 through embedding the snapping block 23 into the fixing hole 113.

The structure of the second positioning element 3 is substantially resembled to the first positioning element 2 (common components) and also contains a base body 31 and a pulley block 32, so the second positioning element 3 may also be fixed at a position spaced away from the second end of the head rail 11 with an adequate distance.

Figure 3:
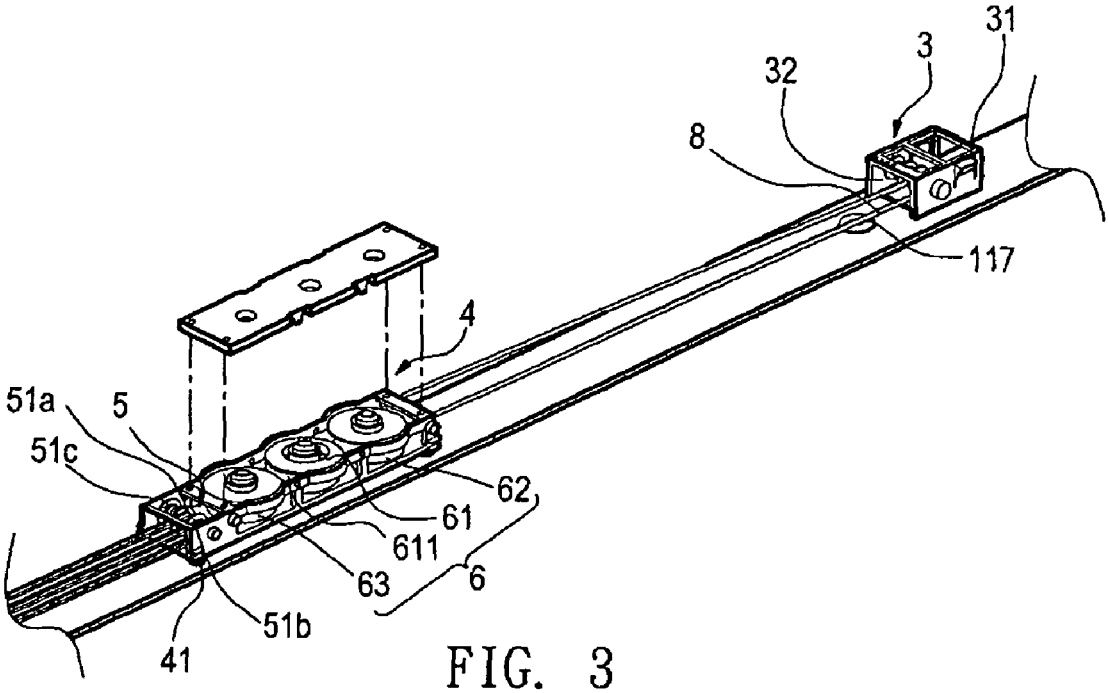
FIG. 3 is a perspective view of a movable seat and a second positioning element according to the present invention.

Referring to FIG. 3, it is a perspective view of a movable seat according to the present invention. The movable seat 4 may be movably disposed within the head rail 11. The movable seat 4 has a pulley block 5 disposed on one side thereof adjacent to the first positioning element 2, and has a cord-winding assembly 6 disposed on the other side. The blind body 12 is disposed beneath the head rail 11. The blind body 12 of the present invention is, for example, a honeycomb shade, but not limited to this.

The pulley block 5 of the movable seat 4 also has a corresponding number of pulleys 51*a*, 51*b*, and 51*c* identical to the pulley block 22 of the first positioning element 2. The cord-winding assembly 6 of the movable seat 4 has a cord winder 61 and two torsion springs 62 and 63.

A first end of the retrieving cord 8 is fixed on the cord winder 61, and the cord winder 61 is connected to the torsion springs 62 and 63. One end of the cord winder 61 has a winding groove 611 capable of adjusting the extent of the torque force. When the torsion springs 62 and 63 generate associate amount of the torque force and delivered to the winding groove 611, such torque force can be substantially increased if the radius of the bottom portion of the winding groove 611 is substantially small. However, if replaced with a larger radius of the bottom portion of the winding groove 611, such torque force will be relatively reduced to a smaller level. Therefore, users can adapt to incorporate the winding groove 611 either with a relatively larger or a smaller radius in accordance to the practical needs.

The winding groove 611 is constructed and arranged for the retrieving cord 8 to be wound up thereon, and the other end of the cord winder 61 has buckling slots 61*a* and 61*b* (shown in FIG. 5) respectively disposed corresponding to each torsion spring 62, 63, so as to connect to one end of the torsion springs 62 and 63 by buckling engagement. The cord winder 61 is driven by the torsion springs 62 and 63 thereby, to wind up the first end of the retrieving cord 8 thereon.

Figure 5:
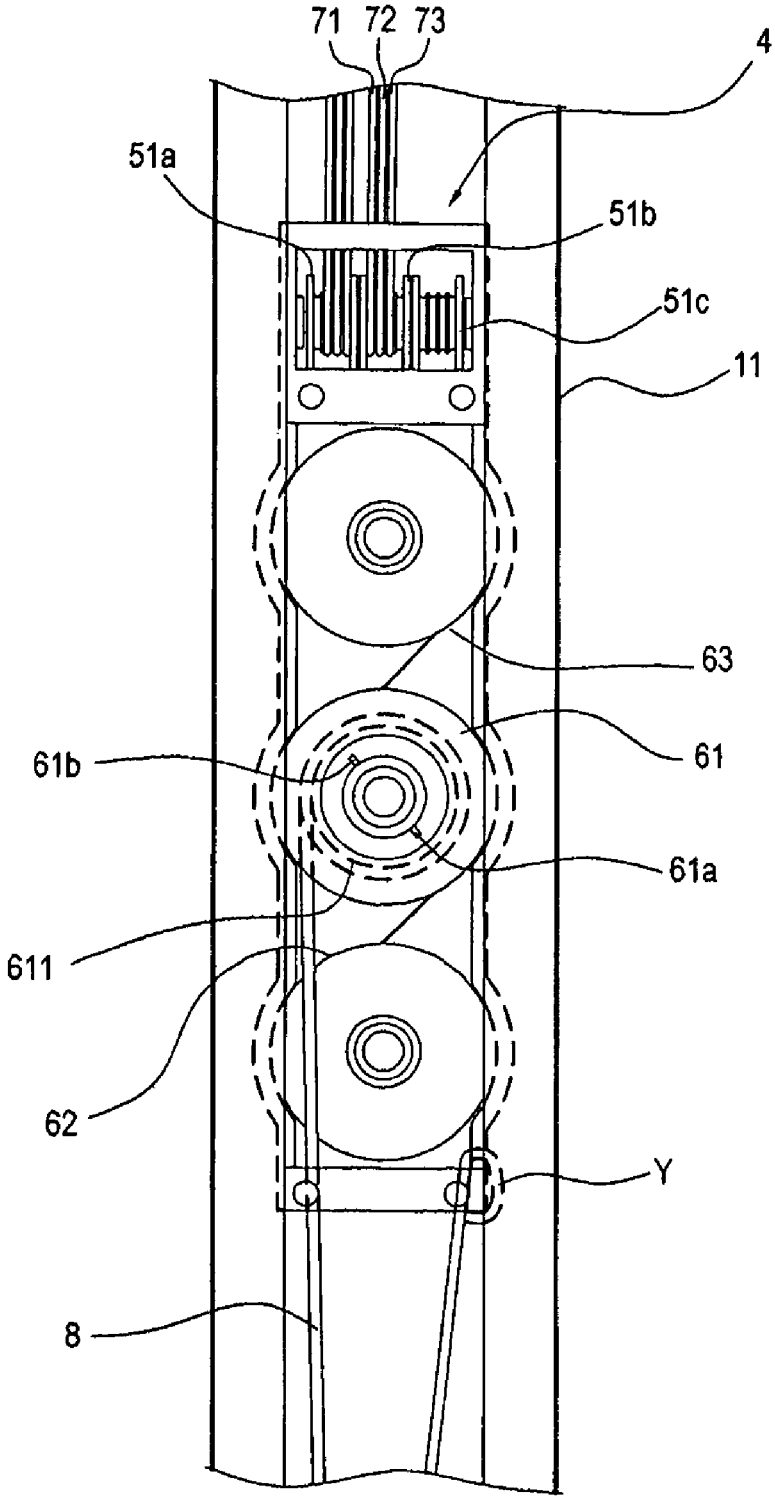
FIG. 5 is an enlarged view of a lift cord wound on a pulley block of the movable seat according to the present invention.

Referring to FIG. 5, a second end of the retrieving cord 8 is fixed on a predetermined position (Y) of the movable seat 4 after winding through the second positioning element 3 thereby, doubly reducing the speed of lateral motions of the movable seat 4 therealong the head rail and augment the recoiling torque force of the torsion springs 62 and 63. The predetermined position (Y) is located on a side edge of the movable seat 4, and spaced away from the central portion of the movable seat 4 with an adequate distance.

In the embodiment, the retrieving cord 8 winding through the second positioning element 3 is taken as an example; however, in the real practice, the second end of the retrieving cord 8 can be directly fixed on the head rail 11 close to the second end of the head rail 11.

A leg portion 41 is respectively protruded and extended downwardly from each of the four corners of the lower surface of the movable seat 4, such that when the lift cords 72 and 73 extend and travel towards the first positioning element 2, such the lift cords 72 and 73 may pass through a space formed between the lower surface of the movable seat 4 and the bottom wall of the head rail 11 so that the lift cords are free from intervening during practical operation.

The main features of the present invention is characterized in that: Both the pulleys 51*a*, 51*b*, and 51*c* which function as a movable pulley system with the first positioning element 2 and the cord-winding assembly 6 designated for winding up the retrieving cord 8 are constructed and arranged on the movable seat 4.

As the cord-winding assembly 6 incorporating the torsion spring 62, 63 and the cord winder 61 both disposed in alignment with the orientation of the longitudinal axis of the head rail 11, this in turn, will require the movable seat 4 to be constructed into a certain length. Therefore, the disposition of pulleys 51*a*, 51*b*, and 51*c* of the movable seat 4 requires rather small space. And further to this kind of design, it can have two major effects:

1. Both distant ends of the window blind available for cut-down are substantially increased; as the space designated for disposition of the retrieving cord 8 therealong the head rail 11 is reduced, thusly, the distances between the first positioning elements 2 (or second positioning element 3) and the first end (or the second end) of the head rail can be further increased as well, allowing the utmost ends of the head rail 11 to have more spare length for cut-down performance.

2. The movable seat 4 is allowed to move laterally without limitations therealong the head rail 11; as the retrieving cord 8 applies an acting force upon the movable seat 4, resulting the movable seat 4 to be slightly inclined and moved sideways but still capable of moving smoothly within the head rail 11.

One end of each lift cord 71, 72, and 73 respectively winds between the pulley block 5 of the movable seat 4 and the first positioning element 2, and the other end extends to pass through the head rail 11 and the blind body 12 to be fastened on the bottom rail 13. The above winding manner is a preferred implementation manner, but not limited to this.

Alternatively, one end of each lift cord 71, 72, and 73 located between the head rail 11 and the lower end of the blind body 12 may directly pass through the blind body 12 downwardly and then to be fixed on the lower end of the blind body 12, or firstly pass through the blind body 12 downwardly to reach the lower end of the blind body 12 and then wind back upwardly and pass through the blind body 12 to be eventually fixed on the head rail 11, or pass through the blind body 12 upwardly after winding through the bottom rail 13 and, to be fixed on the head rail 11 (not shown).

Figure 4:
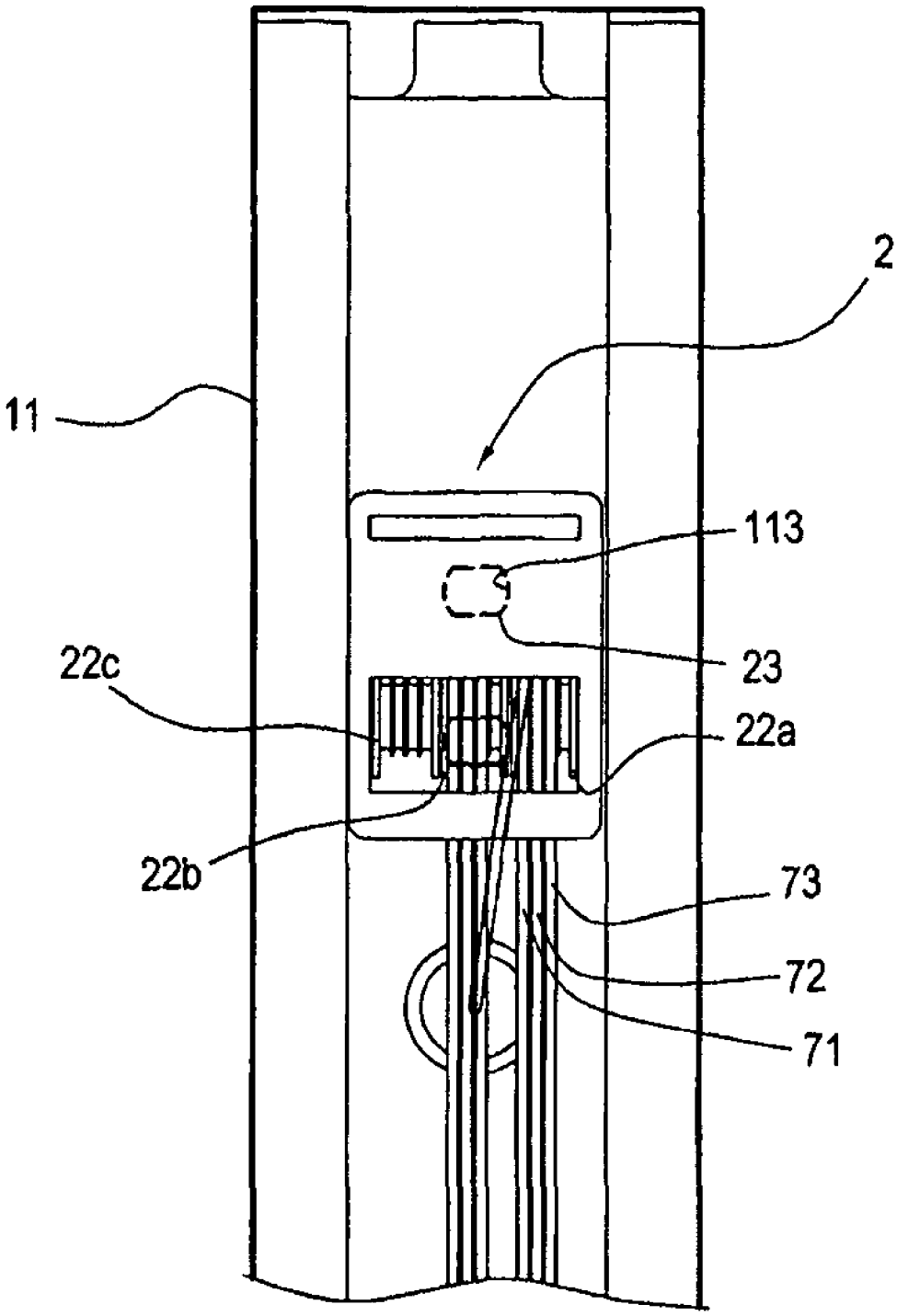
FIG. 4 is an enlarged view of a lift cord wound on the first positioning element according to the present invention.

Referring to FIGS. 3, 4, and 5, in this embodiment, each lift cord 71, 72, and 73 winds through the pulley 22*a* in the first positioning element 2, then routes through the pulley 51*a* of the movable seat 4, then winds back to the pulley 22*b* in the first positioning element 2, and finally winds to the pulley 51*b* of the movable seat 4. Three pulleys are correspondingly disposed in the first positioning element 2 and the movable seat 4 in this embodiment, so if necessary, the number of loops for each lift cord 71, 72, and 73 to be wound between the first positioning element 2 and the movable seat 4 may be increased to three. The relationship between the first positioning element 2 and the movable seat 4 is similar to the relationship between the fixed pulley and the movable pulley. Therefore, not only the labor-saving effect can be achieved, but the moving distance can be further reduced as well. In contrast, the moving stroke of the movable seat 4 within the head rail 11 may be reduced, such that the first positioning element 2 does not need to be disposed at utmost end of the head rail 11, so that both distant ends of the head rail have substantially spare length left available for cut-down purpose. Similarly, the second positioning element 3 positioned with respect to the first positioning element 2 does not need to be disposed on the utmost end of the head rail 11 either, so the extent of the head rail length available to make the cut-down is rather recognizable.

Furthermore, the stretch extent of the blind body 12 is due to the lateral movement of the movable seat 4 therealong the head rail 11, so the available traveling distance of the movable seat 4 within the head rail 11 directly and relatively alters the maximum stretch characteristics of the blind body 12, that is, the full length of the window blind. The pulley block 5 and the cord-winding assembly 6 are constructed and arranged thereon the movable seat 4, so as to increase the available traveling distance of the movable seat 4 within the head rail 11.

Accordingly, if both the head rail length and the full blind body length of the window blind in the present invention are the same as that of the prior art, and since the available moving distance of the movable seat within the head rail is substantially increased, the distance between the first end of the head rail and the first positioning element or the distance between the second end of the head rail and the predetermined position (or the second positioning element) can be relatively increased as well, allowing greater extent for head rail cut-down on both distant ends.

Also, by increasing the number of loops that the lift cords 71, 72, and 73 wound onto the first positioning element 2 and the movable seat 4 (similar method for displacement ratio employed to a combination of the fixed pulley and the movable pulley), or by increasing the number of loops that the retrieving cord 8 wound onto the cord winder 61 (this is relevant to the position where the retrieving cord 8 is fixed on the head rail 11) is increased, or combination of both, the available traveling distance which in turn defines the lateral movement of the movable seat 4 within the head rail 11 can substantially be increased so that the maximum stretch characteristics of the blind body 12, which is equivalent to the full length of the window blind can be made longer spatially. The above mentioned manner is the preferred implementation manner, but not limited to this.

Figure 6A:
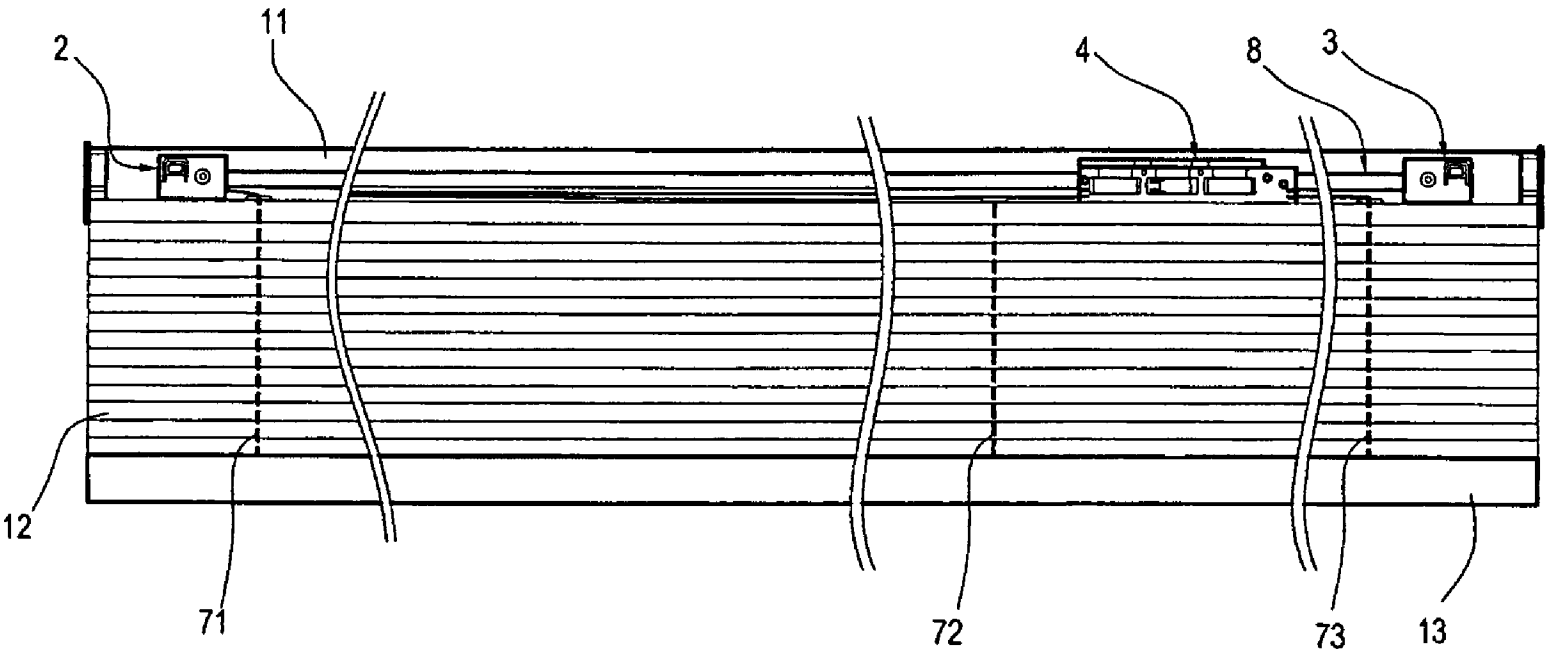
FIG. 6*a* is a schematic view of the present invention when an upwardly external force is being exerted on the bottom rail of which is risen to a first position.
Figure 6B:
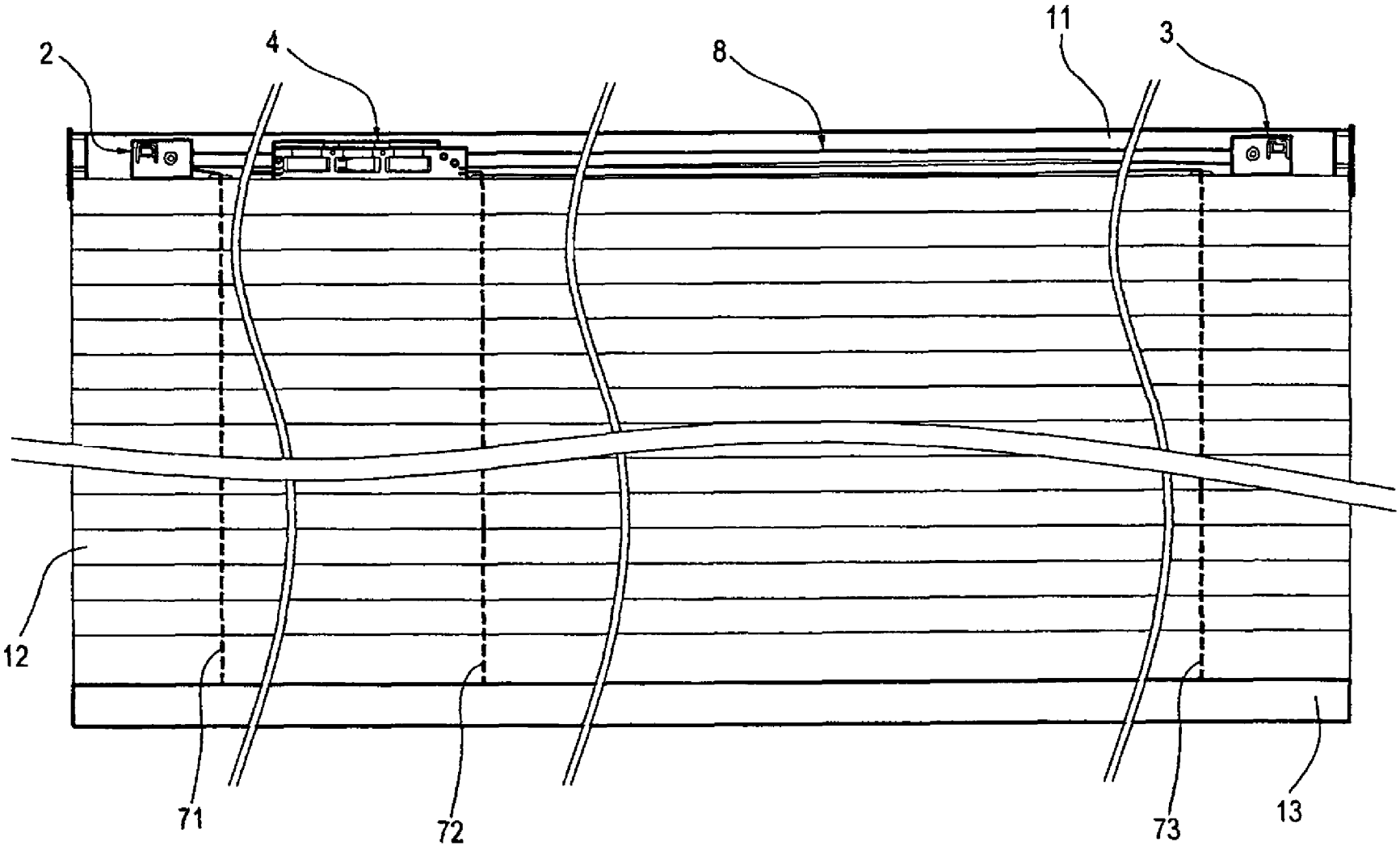
FIG. 6*b* is a schematic view of the present invention when a downwardly external force is being exerted on the bottom rail of which is pulled to a second position.

Referring to FIGS. 6*a* and 6*b*, FIG. 6*a* is schematic view of the present invention when being pushed upwardly to reach a first position, and FIG. 6*b* is a schematic view of the present invention when being pulled downwardly to reach a second position. Referring to FIGS. 1 and 3, when an external force is exerted upwardly on the bottom rail 13, the rewinding force of each torsion spring 62 and 63 cause the cord-winding assembly 6 to be rewound, then the retrieving cord 8 is rewound by the cord-winding assembly 6, and meanwhile, the movable seat 4 moves towards the direction of the cord-winding assembly 6. Due to the friction force generated by each lift cord 71, 72, and 73 which is respectively attached to one end of the pulley block 5 of the movable seat 4 and being routed through the first positioning element 2 and the through holes 115, 116, and 117 of the head rail 11, the blind body 12 is then being raised upwardly to the desirable first position by the user. Alternatively, when an external force is exerted downwardly upon the bottom rail 13, one end of the lift cords 71, 72, and 73 are respectively attached to the pulley block 5 of the movable seat 4, leading the movable seat 4 to move towards the first positioning element 2. And since one end of the retrieving cord 8 is fixed on the second positioning element 3, when the movable seat 4 moves towards the direction of the first positioning element 2, the other end of the retrieving cord 8 is simultaneously released by the cord-winding assembly 6, so each torsion spring 62 or 63 is being extended to generate a restoring force. Accordingly, the restoring force produced by each torsion spring 62 or 63, together with the friction force generated by each lift cord 71, 72, and 73 attached to an end of the pulley block 5 of the movable seat 4 and routed through the first positioning element 2 and the through holes 115, 116, and 117 of the head rail 11, making the blind body 12 to be extended downwardly and to be suspended at the second position desired by the user.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A cordless window blind structure, comprising:

a head rail, having a predetermined opening structure and a predetermined length;

a first positioning element, fixed within the head rail at one side corresponding to the orientation of a longitudinal axis of the head rail thereof and spaced apart by a certain distance from a first end of the head rail;

a movable seat, movably disposed within the head rail, wherein the movable seat has a pulley block disposed at one side in proximity to the first positioning element and has a cord-winding assembly disposed on the other side thereof;

a blind body, disposed beneath the head rail;

at least one lift cord, having one end wound between the movable seat and the first positioning element, and of which the other end extending therebetween the head rail and lower portions of the blind body; and a retrieving cord, wherein one end of the retrieving cord is attached to the cord-winding assembly, and of which the other end is either fastened to a predetermined position thereon the head rail; or is subsequently fixed upon the movable seat after being routed through the predetermined position, and a predetermined distance is formed therebetween the second end of the head rail and the predetermined position, wherein the cord-winding assembly has a cord winder and at least one torsion spring, one end of the retrieving cord is attached to the cord winder constructed and arranged to engage with the torsion spring so as to counter-wind or recoil the retrieving cord accordingly.

2. The cordless window blind structure as claimed in claim 1, wherein said first positioning element has a base body and a plurality of pulleys, and a corresponding number of pulley blocks are disposed on the movable seat thereof.

3. The cordless window blind structure as claimed in claim 2, wherein the head rail further has at least one fixing hole, the base body extends downwardly to form a snapping block, permitting the base body to be fixed thereon the head rail through embedding the snapping block into the respective fixing hole.

4. The cordless window blind structure as claimed in claim 1, wherein one end of the cord winder has a winding groove provided for the retrieving cord to wind up thereon, and the other end of the cord winder has a buckling slot arranged in corresponding position to each torsion spring thereby, allowing one end of the torsion spring to be attached thereon through buckling engagement.

5. The cordless window blind structure as claimed in claim 1, wherein a plurality of leg portions are protruded and extended downwardly from a lower surface of the movable seat, allowing the lift cords to be smoothly routed through a space formed therebetween the lower surface of the movable seat and a bottom wall of the head rail.

6. The cordless window blind structure as claimed in claim 1, wherein the head rail has a plurality of through holes at the bottom portions thereof for the lift cords to pass through.

7. The cordless window blind structure as claimed in claim 1, wherein two ends of the head rail have at least one end cap disposed thereon.

8. The cordless window blind structure as claimed in claim 1, further comprising a bottom rail disposed beneath the blind body.

9. A cordless window blind structure, comprising:

a head rail, having a predetermined opening structure and a predetermined length;

a first positioning element, fixed within the head rail at one side corresponding to the orientation of a longitudinal axis of the head rail thereof, and spaced apart by a certain distance from a first corresponding end of the head rail;

a movable seat, movably disposed within the head rail, wherein the movable seat has a pulley block disposed at one side in proximity to the first positioning element and has a cord-winding assembly disposed on the other side thereof;

a blind body, disposed beneath the head rail;

at least one lift cord, having one end wound therebetween the movable seat and the first positioning element, and of which the other end extending therebetween the head rail and lower portions of the blind body;

a second positioning element, fixed within the head rail and positioned in proximity to one side of the cord-winding assembly of the movable seat, and spaced apart by a certain distance from a second corresponding end of the head rail; and a retrieving cord, wherein one end of the retrieving cord is attached to the cord-winding assembly, and the other end is either fastened on the head rail or subsequently fixed to the movable seat after being routed through a predetermined position of the head rail, or alternatively attached to a predetermined position of the second positioning element, wherein the cord-winding assembly has a cord winder and at least one torsion spring, one end of the retrieving cord is attached to the cord winder which is constructed and arranged to engage with the torsion spring so as to counter-wind or recoil the retrieving cord accordingly.

10. The cordless window blind structure as claimed in claim 9, wherein the first and second positioning elements respectively have a base body and a plurality of pulleys, and a corresponding number of pulley blocks are disposed on the movable seat thereof.

11. The cordless window blind structure as claimed in claim 9, wherein the other end of the retrieving cord is fastened to the movable seat in a sequence that such end of the retrieving cord is firstly wound through the second positioning element and then fixed on the movable seat.

12. The cordless window blind structure as claimed in claim 10, wherein the head rail further has at least one fixing hole, at least one of the base bodies extends downwardly to form a snapping block, permitting the base body to be fixed thereon the head rail through embedding the snapping block into the respective fixing hole.

13. The cordless window blind structure as claimed in claim 9, wherein one end of the cord winder has a winding groove provided for the retrieving cord to wind up thereon, and the other end of the cord winder has a buckling slot arranged in corresponding position to each torsion spring thereby, allowing one end of each torsion spring to be attached thereon through buckling engagement.

14. The cordless window blind structure as claimed in claim 9, wherein a plurality of leg portions are protruded and extended downwardly from a lower surface of the movable seat, allowing the lift cords to be smoothly guided through a space formed therebetween the lower surface of the movable seat and a bottom wall of the head rail.

15. The cordless window blind structure as claimed in claim 9, further comprising a bottom rail disposed beneath the blind body.

16. The cordless window blind structure as claimed in claim 9, wherein the head rail has a plurality of through holes at the bottom portions thereof for the lift cords to pass through.

17. The cordless window blind structure as claimed in claim 9, wherein two ends of the head rail have at least one end cap disposed thereon.

* * * * *